US011583781B2

(12) United States Patent
Sabens et al.

(10) Patent No.: US 11,583,781 B2
(45) Date of Patent: Feb. 21, 2023

(54) SYSTEMS AND METHODS FOR ACTUATING A SHOW ELEMENT ON A RIDE VEHICLE

(71) Applicant: Universal City Studios LLC, Universal City, CA (US)

(72) Inventors: Scott David Sabens, Orlando, FL (US); Christine Marie Sorrentino, Orlando, FL (US); Justin Michael Schwartz, Orlando, FL (US); Eric Shawn Thomas, Orlando, FL (US); Eric Alan Vance, Orlando, FL (US)

(73) Assignee: Universal City Studios LLC, Universal City, CA (US)

( * ) Notice: Subject to any disclaimer, the term of this patent is extended or adjusted under 35 U.S.C. 154(b) by 688 days.

(21) Appl. No.: 16/551,333

(22) Filed: Aug. 26, 2019

(65) Prior Publication Data

US 2020/0086220 A1 Mar. 19, 2020

Related U.S. Application Data

(60) Provisional application No. 62/732,310, filed on Sep. 17, 2018.

(51) Int. Cl.
*A63G 7/00* (2006.01)
*A63G 31/06* (2006.01)

(52) U.S. Cl.
CPC ..... *A63G 7/00* (2013.01); *A63G 31/06* (2013.01)

(58) Field of Classification Search
CPC ..... A63G 21/04; A63G 31/02; A63G 31/04; A63G 31/06; A63G 31/08; A63G 31/16; A63G 4/00; A63G 7/00
See application file for complete search history.

(56) References Cited

U.S. PATENT DOCUMENTS 2,595,992 A * 5/1952 Davey ..... A63G 21/04 293/1
3,847,084 A * 11/1974 Fouche ..... A63G 1/00 104/20

(Continued)

FOREIGN PATENT DOCUMENTS

CN 1347334 A 5/2002
CN 101277744 A 10/2008
CN 107960059 A 4/2018

OTHER PUBLICATIONS

PCT/US2019/049474 International Search Report and Written Opinion dated Dec. 4, 2019.

(Continued)

*Primary Examiner* — Zachary L Kuhfuss
*Assistant Examiner* — Cheng Lin
(74) *Attorney, Agent, or Firm* — Fletcher Yoder, P.C.

(57) ABSTRACT

A ride vehicle system includes a ride track and a ride vehicle. The ride track includes a vehicle rail and an accessory rail. The ride vehicle includes a ride vehicle base, a show element coupled to the ride vehicle base, and a mechanical linkage. The ride vehicle base is configured to interface with the vehicle rail of the ride track and to move along the vehicle rail of the ride track. The show element coupled to the ride vehicle base is configured to actuate with respect to the ride vehicle base. The mechanical linkage includes a first end coupled to the show element and a second end coupled to the accessory rail of the ride track. The mechanical linkage is configured to move along the accessory rail and to actuate the show element based at least in part on a position of the accessory rail with respect to the vehicle rail.

18 Claims, 7 Drawing Sheets

(56) References Cited

U.S. PATENT DOCUMENTS

| | | | | |
|---|---|---|---|---|
| 5,403,238 | A * | 4/1995 | Baxter | A63G 31/16<br>472/43 |
| 6,170,402 | B1 | 1/2001 | Rude et al. | |
| 6,523,479 | B1 | 2/2003 | Schilke et al. | |
| 7,484,460 | B2 | 2/2009 | Blum et al. | |
| 8,517,848 | B2 | 8/2013 | Crawford et al. | |
| 9,526,997 | B2 | 12/2016 | McVeen | |
| 10,315,120 | B2 | 6/2019 | McVeen et al. | |

OTHER PUBLICATIONS

CN Office Action for Chinese Application No. 201980060439.4 dated Aug. 9, 2022.

* cited by examiner

SYSTEMS AND METHODS FOR ACTUATING A SHOW ELEMENT ON A RIDE VEHICLE

CROSS-REFERENCE TO RELATED APPLICATIONS

The present application claims the benefit of U.S. Provisional Application No. 62/732,310, entitled "Systems and Methods for Actuating a Show Element on a Ride Vehicle" and filed Sep. 17, 2018, the disclosure of which is incorporated herein by reference for all purposes.

BACKGROUND

The present disclosure relates generally to the field of amusement parks. Specifically, embodiments of the present disclosure relate to techniques for actuating a show element on an amusement park ride vehicle.

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Since the early twentieth century, amusement parks have substantially grown in popularity. To maintain this growth in popularity, new amusement park attractions are designed to provide guests with unique motion and visual experiences. Most amusement park attractions include ride vehicles that carry passengers along a ride path. Some amusement park attractions may incorporate show elements along the ride path to augment a visual experience of the amusement park attraction. Accordingly, it is recognizable that it is desirable for an amusement park attraction to incorporate a unique show element to provide guests with unique motion and visual experiences.

SUMMARY

Certain embodiments commensurate in scope with the originally claimed subject matter are summarized below. These embodiments are not intended to limit the scope of the disclosure, but rather these embodiments are intended only to provide a brief summary of certain disclosed embodiments. Indeed, the present disclosure may encompass a variety of forms that may be similar to or different from the embodiments set forth below.

In an embodiment, a ride vehicle system includes a ride track having a vehicle rail and an accessory rail. The ride vehicle system also includes a ride vehicle having a ride vehicle base configured to interface with the vehicle rail of the ride track. The ride vehicle base is configured to move along the vehicle rail of the ride track. The ride vehicle also includes a show element coupled to the ride vehicle base. The show element is configured to actuate with respect to the ride vehicle base. Moreover, the ride vehicle includes a mechanical linkage having a first end coupled to the show element and a second end coupled to the accessory rail of the ride track. The mechanical linkage is configured to move along the accessory rail and to actuate the show element based at least in part on a position of the accessory rail with respect to the vehicle rail.

In an embodiment, a ride vehicle includes a ride vehicle base configured to interface with a vehicle rail of a ride track. The ride vehicle base is configured to move along the vehicle rail of the ride track. Moreover, the ride vehicle includes a show element coupled to the ride vehicle base. The show element is configured to actuate with respect to the ride vehicle base. Further, the ride vehicle includes a mechanical linkage having a first end coupled to the show element and a second end coupled to an accessory rail of the ride track. The mechanical linkage is configured to actuate the show element based at least in part on a position of the accessory rail with respect to the vehicle rail.

In an embodiment, a method includes moving a ride vehicle along a vehicle rail of a ride track. The method also includes actuating a mechanical linkage to move a show element coupled to the ride vehicle based at least in part on a position of an accessory rail of the ride track with respect to the vehicle rail. A position of the accessory rail is configured to vary with respect to the vehicle rail along the ride track. Further, the show element is configured to actuate with respect to the ride vehicle.

In an embodiment, a ride vehicle includes a ride vehicle base configured to interface with a ride track. The ride vehicle base is also configured to move along the ride track within a range of motion that defines a ride vehicle base envelope. The ride vehicle also includes a show element coupled to the ride vehicle base. The show element is configured to actuate with respect to the ride vehicle base and outside of the ride vehicle base envelope. The ride vehicle also includes a controller configured to control positioning of the show element to avoid collisions of the show element with structures outside of the ride vehicle base envelope.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Typical amusement park attractions (e.g., roller coasters or dark rides) include ride vehicles that move along a ride track. Additionally, some amusement park attractions include show events such as animatronics, props, lighting effects, screen displays, etc. to augment a visual experience for passengers in the ride vehicles. Traditionally, show elements are disposed at specific locations in the amusement park attraction. For example, an animatronic lion may be moving through a grass field adjacent to the ride track, and may roar or turn towards the ride vehicle when the ride vehicle passes the animatronic lion. However, once the ride vehicle continues along the ride track, the passengers are no longer in the vicinity of the animatronic lion. Placing many show elements along the ride track may be resource intensive, both in terms of cost and design time. Accordingly, it may be desirable to have a show element that moves with the ride vehicle to provide a unique visual experience for the passengers.

By using the systems and methods described herein to actuate a show element coupled to a ride vehicle, passengers may enjoy the visual experience from the show element along an entire ride track.

Figure 1:
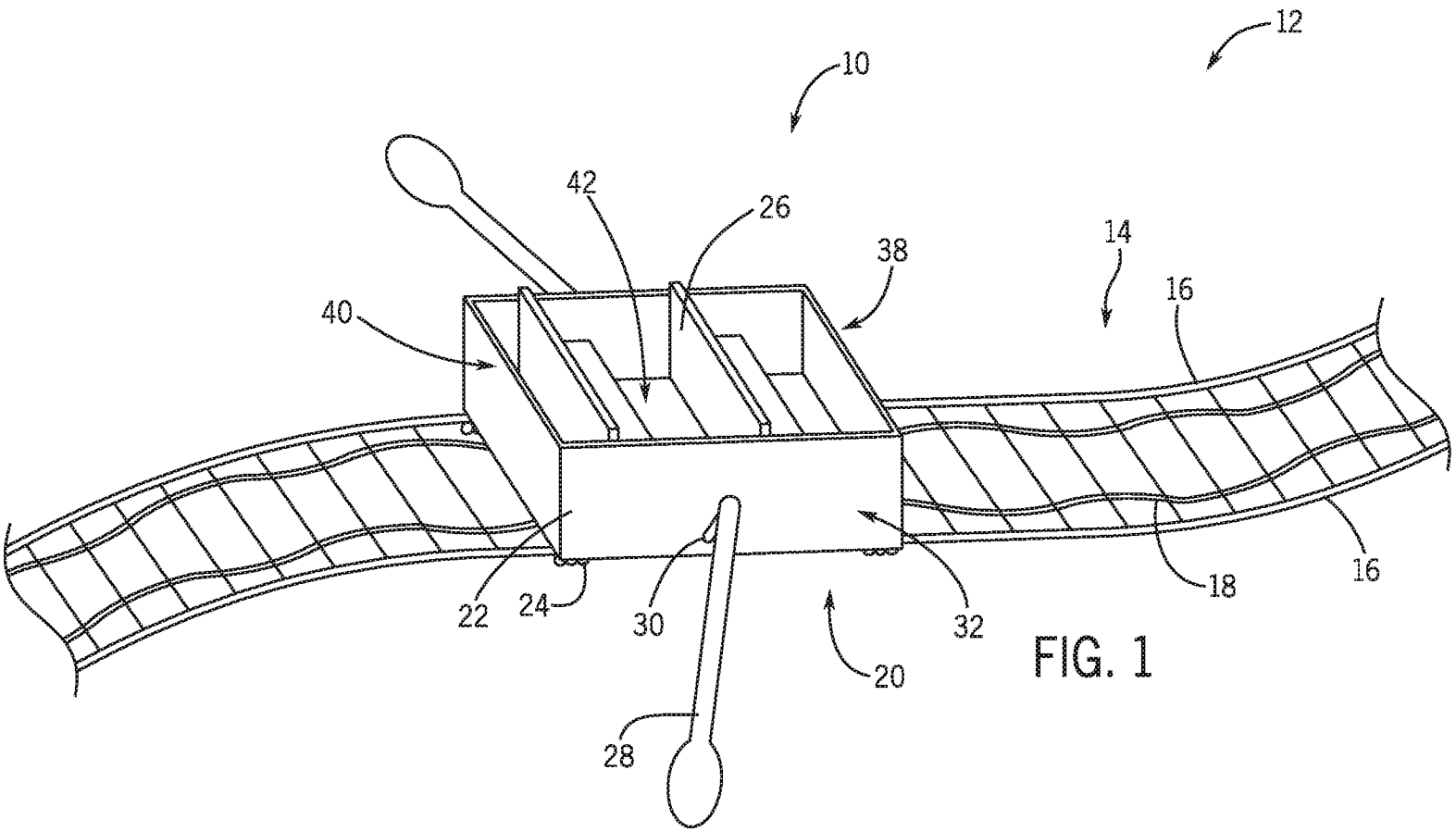
FIG. 1 is a perspective view of an embodiment of a ride vehicle system in accordance with present techniques.

FIG. 1 is a perspective view of an embodiment of a ride vehicle system 10 for an amusement park attraction 12. The ride vehicle system 10 includes a ride track 14 having a vehicle rail 16 and an accessory rail 18. The ride vehicle system 10 also includes a ride vehicle 20 (e.g., roller coaster or dark ride) having a ride vehicle base 22 configured to interface with the vehicle rail 16 and move along the vehicle rail 16 of the ride track 14. In some embodiments, the ride vehicle base 22 includes a friction wheel assembly 24 configured to interface with the vehicle rail 16. However, in other embodiments, the ride vehicle 20 may move along the vehicle rail 16 using any suitable propulsion or interface assembly. Additionally, the ride vehicle 20 may have one or more ride seats 26 attached to the ride vehicle base 22, such that the ride vehicle 20 may hold one or more passengers as the ride vehicle 20 travels along the ride track 14. The ride vehicle base 22 may include a frame or body of the ride vehicle 20.

Moreover, the ride vehicle 20 has a show element 28 coupled to the ride vehicle base 22. In some embodiments, the show element 28 is coupled to the ride vehicle base 22 via a mechanical linkage 30. In some embodiments, the mechanical linkage 30 is coupled to a side portion 32 of the ride vehicle base 22. As such, the show element 28 may be coupled to a side portion 32 of the ride vehicle base 22. In some embodiments, a plurality of show elements 28 may be coupled to the ride vehicle base 22. For example, in a pirate themed attraction, the ride vehicle 20 may have a pirate ship appearance, and the plurality of show elements 28 may be a pair of oars for the pirate ship. A first oar may be coupled to a left side 34 of the ride vehicle base 22 and a second oar may be coupled to a right side 36 of the ride vehicle base 22.

However, the show element 28 may be any mechanical device configured to actuate with respect to the ride vehicle base 22 to augment at least a visual experience of an amusement park attraction 12. Additional examples of a show element 28 include a mast and sails, a plank, a mechanical arm, wings, paddles, an animatronic character, a platform for an animatronic character or a special effect device, or any other suitable mechanical device.

In some embodiments, the mechanical linkage 30 is coupled to a front portion 38, a back portion 40, or a top portion 42 of the ride vehicle base 22. For example, in the pirate themed attraction, the show element 28 may be a mast and sails coupled to a top portion 42 of the ride vehicle base 22, a plank coupled to a back portion 40 of the ride vehicle base 22, or a cannon coupled to a front portion 38 of the ride vehicle base 22. In some embodiments, the ride vehicle 20 may have a plurality of mechanical linkages 30 such that a plurality of show elements 28 may be coupled to the front portion 38, the back portion 40, and the top portion 42 of the ride vehicle base 22.

The show elements 28 may be configured to actuate with respect to the ride vehicle base 22. In some embodiments, the mechanical linkage 30 may be configured to actuate the show element 28 upward, downward, forward, rearward, outward, inward, or some combination thereof, with respect to the ride vehicle base 22. For example, in the pirate themed attraction, each oar of the pair of oars may actuate with respect to the ride vehicle base 22 to create the appearance that the oars are rowing a pirate ship, the mast and sails may lean with respect to the ride vehicle base 22 to create the appearance of a strong wind, the plank may wobble up and down with respect to the ride vehicle base 22, and the cannon may roll forward with respect to the ride vehicle base 22. In another embodiment, a hydraulic, pneumatic, electric, or mechanical actuator is configured to drive actuation of the show element 28. However, in a further embodiment, both the mechanical linkage 30 and the actuator 44 are configured to drive actuation of the show element 28.

The show element 28 may be configured to actuate based at least in part on a position of the ride vehicle 20 along the ride track 14. A ride system controller may be configured to output a signal to control actuation of the show element 28 based at least in part on a detected position of the ride vehicle 20 along the ride track 14. In some embodiments, the ride vehicle controller is configured to output a signal to control actuation of the show element 28 based at least in part on a detected position of the ride vehicle 20 along the ride track 14. However, in another embodiment, the show element 28 is configured to move based on actuation of the mechanical linkage 30. The mechanical linkage 30 may be configured to actuate the show elements 28 based at least in part on a position of the accessory rail 18 (e.g., with respect to the vehicle rail 16, with respect to the ride vehicle 20, with respect to the ground, and so forth) as the ride vehicle 20 progresses along the ride track 14 such that the show element 28 actuates based on the position of the accessory rail 18 at respective positions along the ride track 14.

Figure 2:
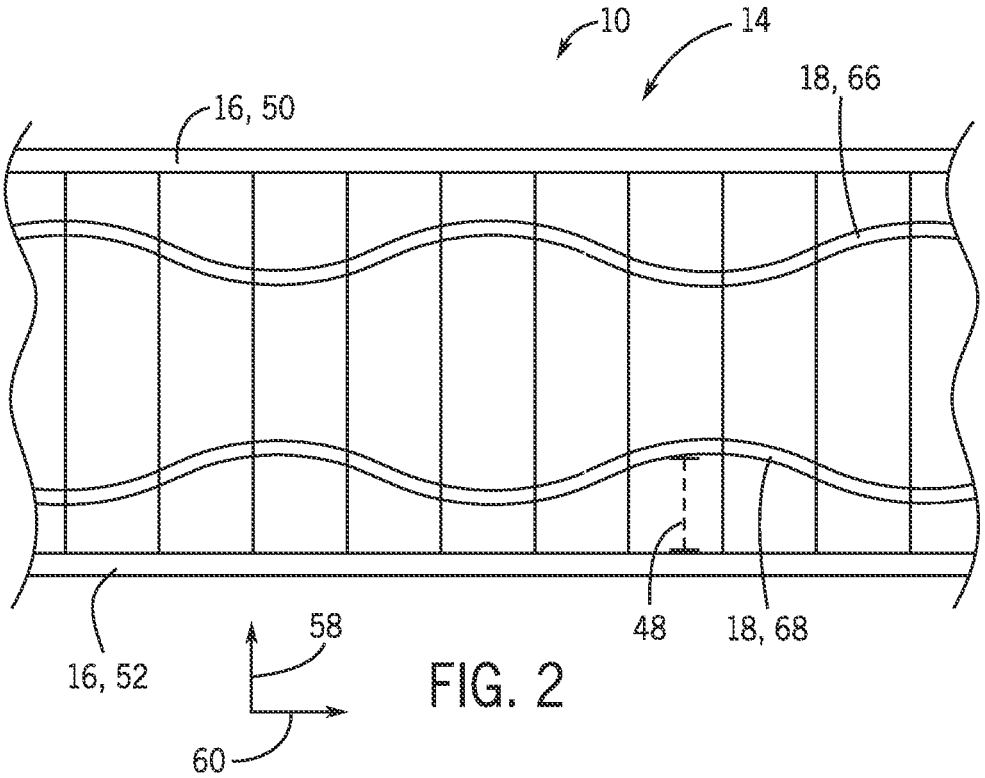
FIG. 2 is a top view of an embodiment of a ride track of the ride vehicle system comprising an accessory rail in accordance with present techniques.

FIG. 2 is a top view of an embodiment of a ride track 14 of the ride vehicle system 10 comprising the accessory rail 18. The accessory rail 18 may be disposed adjacent the vehicle rail 16. The accessory rail 18 may be adjacent the vehicle rail 16 for an entire length of the ride track 14. A distance 48 between the accessory rail 18 and the vehicle rail 16 may vary along the ride track 14. A change in the distance 48 between the accessory rail 18 and the vehicle rail 16 may cause the show element 28 to actuate.

In some embodiments, the ride track 14 may have a plurality of vehicle rails 16 that interface with the ride vehicle 20. The ride track 14 may include a left vehicle rail 50 and a right vehicle rail 52 configured to interface with a left portion of the ride vehicle base 22 and a right portion of the ride vehicle base 22 respectively. The accessory rail 18 may be disposed between the left vehicle rail 50 and the right vehicle rail 52 in a horizontal direction 58 with respect to the ride vehicle 20. However, in other embodiments the accessory rail 18 may be disposed outside of the plurality of vehicle tracks 16. The horizontal direction 58 with respect to the ride vehicle 20 may be defined as a direction along a line intersecting the left vehicle rail 50 and the right vehicle rail 52 and generally perpendicular or transverse to a direction of travel of the ride vehicle 60 along the ride track 14. The mechanical linkage 30 may be configured to actuate based at least in part on a position of the accessory rail 18 with respect to the vehicle rail 16. In some embodiments, the mechanical linkage may include one or more cams, or may interface with the accessory rail 18 and/or the show element 28 via one or more cams. Actuation of the mechanical linkage 30 may be based at least in part on the position of the accessory rail 18 relative to the vehicle rail 16 (e.g., based on a distance between the accessory rail 18 and the vehicle rail 16 in the horizontal direction 58). However, in other embodiments, actuation of the mechanical linkage 30 may be based at least in part on an absolute distance between the accessory rail 18 and the vehicle rail 16, a position of the accessory rail 18 relative to the ride vehicle 20, a position of the accessory rail 18 relative to the ground, or the position of the accessory rail 18 relative to some other object.

The mechanical linkage 30 may be configured to actuate based at least in part on a position of the accessory rail 18 with respect to the left vehicle rail 50 or the right vehicle rail 52 based on a design of the mechanical linkage 30. For example, in an embodiment wherein the mechanical linkage 30 is coupled to the accessory rail 18, the right vehicle rail 52 or a right portion of the ride vehicle base 22, and the show element 28, the mechanical linkage 30 may be configured to actuate based at least in part on a position of the accessory rail 18 with respect to the right vehicle rail 52.

The ride track 14 may include a plurality of accessory rails 18. In some embodiments, a number of accessory rails 18 corresponds to a number of show elements 28 coupled to the ride vehicle base 22, such that each show element 28 has a respective accessory rail 18. For example, a ride vehicle 20 having a first show element 20 coupled to a left side of the ride vehicle base 22 and a second show element coupled to the right side of the ride vehicle base 22 may have a left accessory rail 66 and a corresponding right accessory rail 68. In another embodiment, a plurality of show elements 28 may correspond to a single accessory rail 18, such that the distance 48 between the single accessory rail 18 and the vehicle rail 16 is configured to control actuation of a plurality of show elements 28. For example, a single accessory rail 18 may control actuation of both the first show element 28 and the second show element 28.

Figure 3:
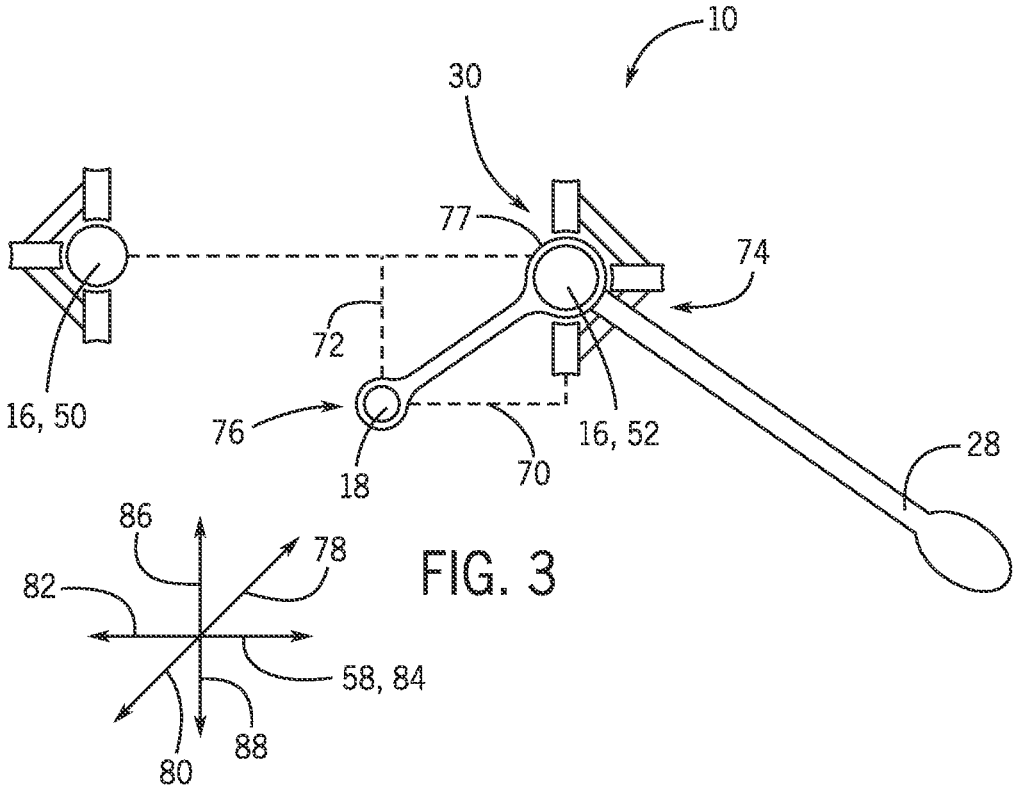
FIG. 3 is a cross-sectional view of another embodiment of the ride track of the ride vehicle system comprising the accessory rail, a show element, and a mechanical linkage of a ride vehicle of the ride vehicle system in accordance with present techniques.

FIG. 3 is a cross-sectional view of another embodiment of the ride track 14 of the ride vehicle system 10 comprising the accessory rail 18, the show element 28, and the mechanical linkage 30 of the ride vehicle 20 of the ride vehicle system 10 in accordance with present techniques. The accessory rail 18 may be disposed between the left vehicle rail 50 and the right vehicle rail 52. In some embodiments, the accessory rail 18 may have a horizontal offset 70, which is an offset from a corresponding vehicle rail 16 (e.g., the right rail) in the horizontal direction 58. Additionally, a vertical position of the accessory rail 18 may be configured to vary with respect to the corresponding vehicle rail 16 such that the accessory rail 18 may have a vertical offset 72, which is an offset from the corresponding vehicle rail 16 in a vertical direction. Though the accessory rail 18 shown in FIG. 3 includes both the horizontal offset 70 and the vertical offset 72, some embodiments of the accessory rail may include only the horizontal offset 70 or the vertical offset 72.

In some embodiments, the mechanical linkage 30 has a first end 74 coupled to the show element 28 and a second end 76 coupled to the accessory rail 18 of the ride track 14. The mechanical linkage 30 may be configured to move along the accessory rail 18 as the ride vehicle 20 moves along the vehicle rail 16. In some embodiments, the mechanical linkage 30 may have an intermediate portion coupled to and configured to move along the corresponding vehicle rail 16. In another embodiment, the mechanical linkage 30 may be coupled to the ride vehicle base 22 proximate the corresponding vehicle rail 16. Further, the mechanical linkage 30 may be configured to rotate about a hinge 77 disposed at an intermediate portion. For example, though the mechanical linkage 30 shown in FIG. 3 is single body, in other embodiments, the mechanical linkage 30 may include multiple bodies coupled to one another via rigid or moveable joints that move as the position of the accessory rail 18 changes as the ride vehicle proceeds along the vehicle rail 16.

Moving the mechanical linkage 30 with respect to the accessory rail 18 may actuate the show element 28 based at least in part on a position (e.g., vertical offset 72 and horizontal offset 70) of the accessory rail 18 with respect to the vehicle rail 16. Changes in the horizontal offset 70 may cause actuation of the show element 28, via the mechanical linkage 30, in the forward direction 78 or rearward direction 80. However, in some embodiments, changes in the horizontal offset 70 may cause actuation in additional directions (e.g., inward direction 82, outward direction 84, upward direction 86, downward direction 88, or some combination thereof). Further, changes in the vertical offset 72 may cause actuation of the show element 28, via the mechanical linkage 30, in the upward direction 86 or downward direction 88. However, in some embodiments, changes in the vertical offset 72 may cause actuation in additional directions (e.g., inward direction 82, outward direction 84, forward direction 78, rearward direction 80, or some combination thereof).

In some embodiments, changes in the horizontal offset 70 and the vertical offset 72 as the ride vehicle progresses along the ride track 14 control a direction of the actuation of the show element 28; however, a total distance change in the position of the accessory rail 18, determined, for example, by changes in the horizontal and vertical offsets, determines the magnitude of the actuation of the show element 28. In some embodiments, the mechanical linkage 30 may be designed to generate a one-to-one ratio between the total distance change in the accessory rail 18 and the magnitude of actuation of the show element 28 at a distal end 100 of the show element 28. For example, a total distance change of five inches may cause the distal end 100 of the show element 28 to move five inches. In another embodiment, the mechanical linkage 30 may include a gear system. The gear system may cause the mechanical linkage 30 to move the distal end 100 of the show element 28 based on the total distance change according to a gear ratio (e.g., one-to-two ratio, two-to-one ratio, three-to-one ratio, and so forth). For example, for a one-to-two gear ratio, a total distance change of ten inches may cause the show element 28 to move twenty inches. A relative length of the mechanical linkage 30 and/or a length of the show element 28 may inherently create the gear ratio. In other embodiments, the gear system may include one or more gears and/or cams configured to create the gear ratio.

Figure 4:
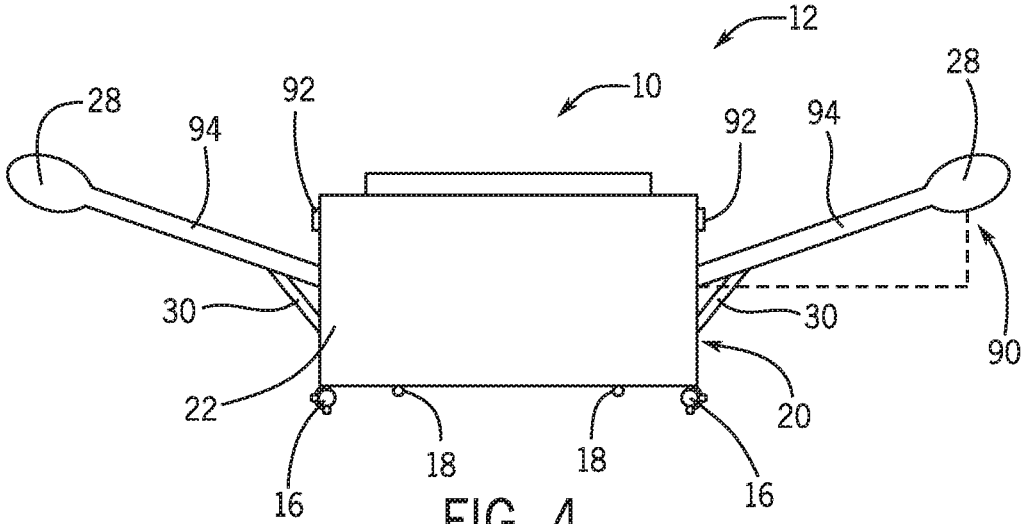
FIG. 4 is a front view of an embodiment of the ride vehicle having a plurality of show elements disposed in an upwards position in accordance with present techniques.

FIG. 4 is a front view of an embodiment of the ride vehicle 20 having a plurality of show elements disposed in an upward position 90. In some embodiments, actuation of the mechanical linkage 30 moves the show element 28 based at least in part on changes in the distance between the accessory rail 18 and the vehicle rail 16. In another embodiment, the mechanical linkage 30 moves the show element 28 based on changes in the distance between the accessory rail 18 and a portion of the ride vehicle base. In some embodiments, the mechanical linkage 30 moves the show element 28 based on changes in the distance between the accessory rail 18 and the ground. In some embodiments, the mechanical linkage 30 may move the show element 28 upwards and downwards with respect to the ride vehicle base 22 to create a unique visual experience for the one or more passengers of the ride vehicle 20. For example, for a bird themed ride vehicle, the show element 28 may appear to be a wing of a bird. The mechanical linkage 30 may move the wing upward and downward to flap the wing.

In another embodiment, the position of the accessory rail 18 may be designed such that the mechanical linkage 30 strategically moves the show element 28 based on one or more stationary or moving elements disposed in the environment surrounding the ride track 14 (e.g., to avoid collisions of the show element 28 with elements disposed in the environment surrounding the ride track 14) outside of a ride vehicle base envelope of the ride vehicle base 22. The ride vehicle base envelope may include a three-dimensional volume that is occupied by the ride vehicle base 22 as the ride vehicle 20 moves along the ride track 14. In some embodiments, the show element 28 may extend outside of the ride vehicle base envelope. For example, an animatronic animal may be disposed in the amusement park attraction proximate the ride track 14. The accessory rail 18 may be designed such that the mechanical linkage 30 may lift the show element 28 upwards as the ride vehicle 20 approaches the animatronic animal, which is outside of the ride base envelope, such that the show element 28 does not collide with the animatronic animal. Specifically, the accessory rail 18 may be positioned with respect to the vehicle track 16 in the area of the animatronic animal such that the mechanical linkage 30 lifts the show element 28 above the animatronic animal.

In another embodiment, the actuator 44 (e.g., pneumatic, hydraulic, mechanical, electrical) may control the position of the show element 28 (i.e., in addition to the mechanical linkage 30 or in place of the mechanical linkage 30) to create unique visual effects and to avoid collisions of the show element 28 with structures along the ride track 14 outside of the ride vehicle base envelope. The actuator 44 may move the show element 28 based at least in part on a control signal received from the ride system controller and/or the ride vehicle controller. The control signal may be based, for example, on signals from one or more sensors indicative of a position of the ride vehicle 20, a position of the show element 28, or some other value. The one or more sensors may be infrared, pressure, electromagnetic, or other suitable sensors for detecting the position of the ride vehicle 20, the position of the show element 28, or some other value. In some embodiments, the one or more sensors are disposed on the ride vehicle (e.g., onboard sensors). In another embodiment, the one or more sensors are disposed along the ride track 14 and/or amusement park attraction 12 (e.g., off-board sensors). In some embodiments, the ride vehicle system 10 may include a fail-safe sensor configuration that includes redundant components (e.g., sensors, controller, communication devices, etc.), fault tolerances, and/or recovery procedures. The fail-safe sensor configuration may increase the accuracy of the control signal. The ride system controller and/or the ride vehicle controller may output the control signal based on a predetermined program, detected obstacles, other factors, or some combination thereof. In some embodiments, the actuator 44 may move the show element 28 in combination with the mechanical linkage 30 (i.e., the path or form of the accessory rail 18 with respect to the vehicle rail 16, ride vehicle 20, ground, or some combination thereof) to avoid collisions of the show element 28 with the structures along the ride track 14 outside of the ride vehicle base envelope.

The ride vehicle system 10 may include a braking system. In some embodiments, the braking system is disposed on the ride vehicle 20 (e.g., on-board braking system). The on-board braking system may be configured to slow or stop movement of the ride vehicle 20 along the ride track 14 in response to a braking signal output from the controller. The controller may be configured to output the braking signal in response to determining that the show element is out of position 28. The on-board braking system may include brakes configured to interface with the friction wheel assembly 24 or any suitable propulsion or interface assembly of the ride vehicle 20. In another embodiment, the braking system may be disposed along the ride track 14 (e.g., off-board braking system). The controller may be configured to output a braking signal to an off-board braking system disposed along the ride track 14 in response to determining that the show element 28 is out of position. The off-board braking system may be configured to slow or stop movement of the ride vehicle 20 along the ride track 14. The off-board braking system may include a block zone configured to activate in response to receiving the brake signal. The off-board braking system may include any suitable mechanism or system configured to slow or stop the ride vehicle 20 along the ride track 14. In some embodiments, the show element 28, the mechanical linkage 30, or some combination thereof may have a release mechanism 92. The release mechanism 92 may be configured to allow a manual disconnect of the show element 28 from the ride vehicle base 22, from the mechanical linkage 30, or both. During maintenance, the show element 28 may create an obstacle that would require a maintenance worker to walk a further distance to move around the vehicle. Thus, the release mechanism 92 may facilitate faster maintenance of the ride vehicle 20. The release mechanism 92 may have a lever or some other suitable type of release trigger to allow for manual release of the show element 28. The lever may be disposed on an interior or exterior of the ride vehicle base 22.

Figure 5:
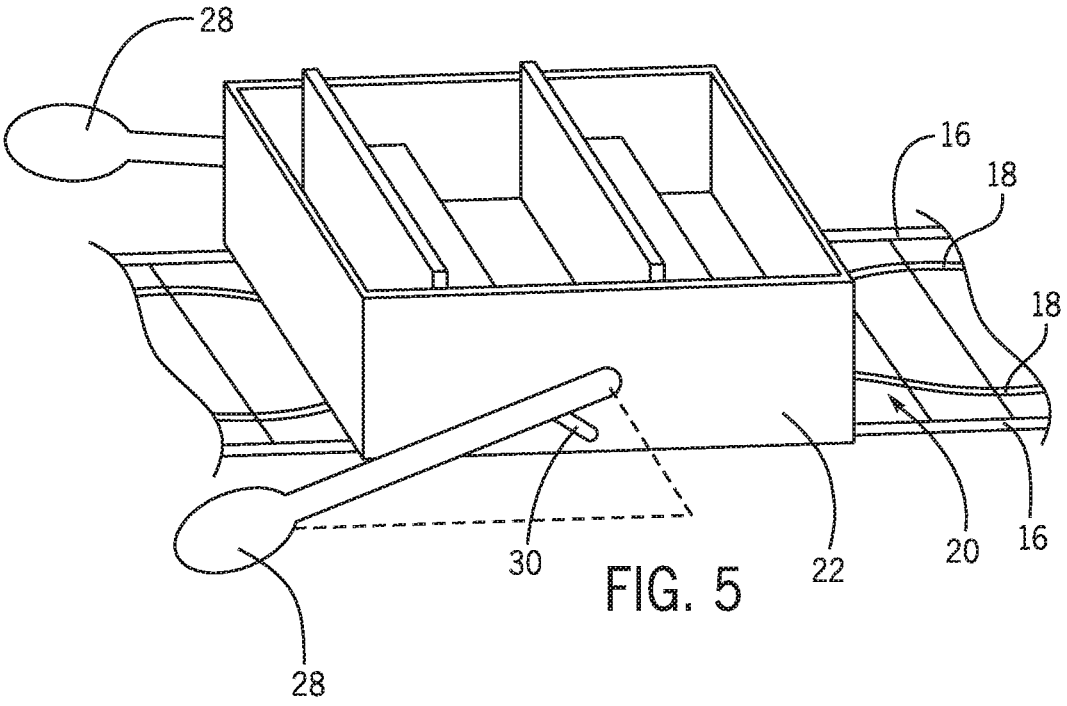
FIG. 5 is a perspective view of another embodiment of the ride vehicle having the show elements disposed in a rearwards position in accordance with present techniques.

FIG. 5 is a perspective view of another embodiment of the ride vehicle 20 having a plurality of show elements 28 disposed in a rearward position 96. In some embodiments, actuation of the mechanical linkage 30 moves the show element 28 based at least in part on changes in the distance between the accessory rail 18 and the vehicle rail 16, the ride vehicle base 22, the ground, or some combination thereof. In some embodiments, the mechanical linkage 30 may move the show element 28 rearwards and forwards with respect to the ride vehicle base 22 to create a unique visual experience for the one or more passengers of the ride vehicle 20. For example, for the bird themed ride vehicle, the show element 28 may appear to be the wing of a bird. The mechanical linkage 30 may move the wing rearward in combination with a downward slope of the ride track to create a motion and visual experience of a bird diving toward the ground.

In another embodiment, the actuator 44 (e.g., pneumatic, hydraulic, mechanical, or electrical actuator) may move the show element 28 rearwards and forwards. The actuator 44 may move the show element 28 rearwards and forwards based at least in part on the control signal received from a ride controller to create unique visual effects according to some pre-defined orchestration, and/or to avoid collisions of the show element 28 with structures along the ride track 14 outside of the ride vehicle base envelope. Additionally, the actuator 44 may move the show element 28 rearwards or forwards at a loading/unloading bay for the ride vehicle 20. Passengers may enter and exit the ride vehicle 20 at the loading/unloading bay. The loading/unloading bay for the ride vehicle 20 may have a narrow opening to the rest of the ride track 14. The show element 28 may move rearwards or forwards to allow the ride vehicle base 22 having the show element 28 to fit through the narrow opening.

Figure 6:
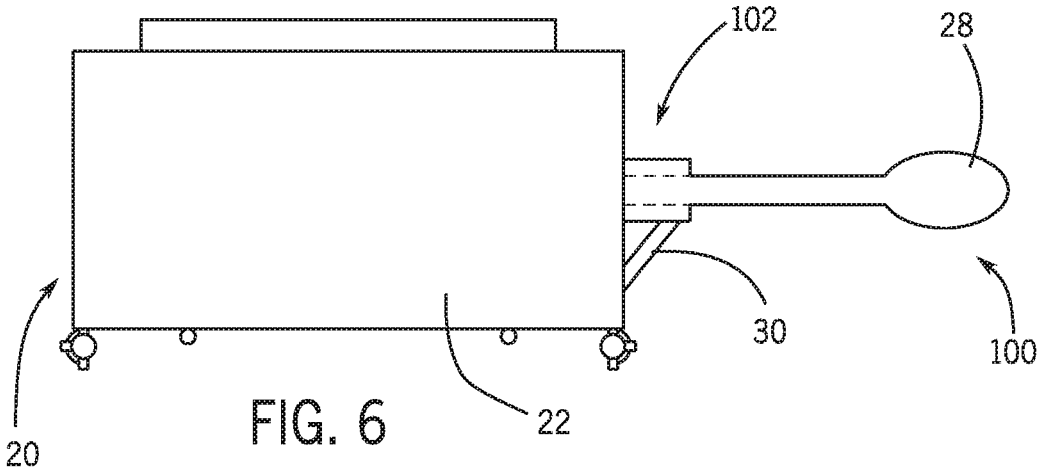
FIG. 6 is a front view of another embodiment of the ride vehicle having the show element disposed in a collapsed position in accordance with present techniques.

FIG. 6 is a front view of another embodiment of the ride vehicle 20 having a show element 28 disposed in a retracted or collapsed position 98. The show element 28 may be configured to extend or retract with respect to the ride vehicle base 22. In some embodiments, the show element 28 has the distal end 100 and a proximal end 102. The distal end 100 is opposite the proximal end 102. The proximal end 102 may be coupled to the ride vehicle base 22 and the distal end 100 is configured to move upward, downward, forward, rearward, outward, inward, or some combination thereof with respect to the proximal end 102. In another embodiment, the proximal end 102 is coupled to the first end 74 of the mechanical linkage 30. The distal end 100 may be configured to extend outward or retract inward with respect to the proximal end 102 of the show element 28. For example, for the pirate themed ride vehicle, a distal end of the oar may be configured to retract with respect to a proximal end of the oar to create a visual effect that the oar is being pulled into a hull of the pirate ship. In another embodiment, the distal end and the proximal end of the oar may retract together (i.e., the whole oar may retract) toward the hull, at least partially into the hull, or at least partially underneath the hull.

Figure 7:
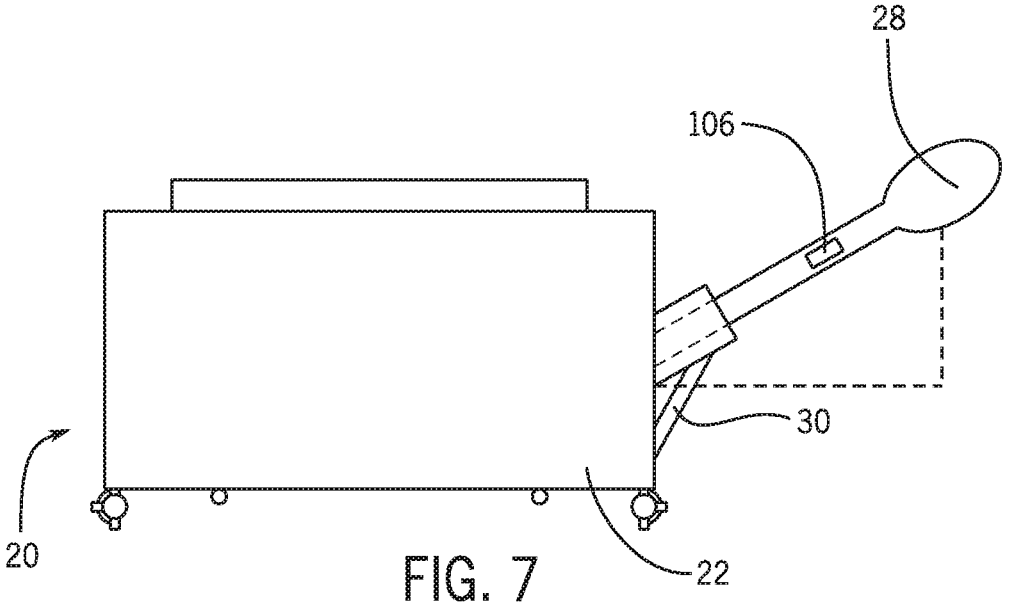
FIG. 7 is a front view of another embodiment of the ride vehicle having the show element disposed in a collapsed, upwards position in accordance with present techniques.

FIG. 7 is a front view of another embodiment of the ride vehicle 20 having a show element 28 disposed in a collapsed, upwards position 104. In some embodiments, both the mechanical linkage 30 and the actuator 44 may be configured to drive actuation of the show element 28. The proximal end 102 of the show element 28 may be coupled to the mechanical linkage 30 such that actuation of the mechanical linkage 30 moves the show element 28 upwards, downwards, rearwards, forwards, or some combination thereof. Additionally, the actuator 44 may be disposed onboard the ride vehicle 20. In some embodiments, the actuator 44 may be coupled to the show element 28. The actuator 44 may be configured to move the distal end 100 of the show element 28 with respect to the proximal end 102. For example, for the pirate themed ride vehicle, the mechanical linkage 30 may actuate the show element 28 (e.g., the oar) to move forward, then downward, then rearward, and then upwards to simulate a rowing motion. Additionally, the actuator 44 may retract and extend the show element 28 (e.g., the oar) in combination with the movement from the mechanical linkage 30 to simulate the inward and outward motion of a row stroke to create a more realistic visual experience for the passengers.

In another embodiment, the show element 28 may have a show element feature 106. In some embodiments, the show element feature 106 is removably coupled to the show element 28. In another embodiment, the show element feature 106 is integral to the show element 28. The actuator 44 may be configured to actuate a show element feature 106 with respect to the show element 28. For example, for an airplane themed ride vehicle, the show element 28 may be a wing of the airplane, and the show element feature 106 may be a flap or aileron. The actuator 44 may be configured to move the flap or aileron with respect to the wing.

Though the show elements 28 shown in FIGS. 1 and 3-7 extend from a side portion 32 of the ride vehicle 20, it should be understood that other embodiments in which show elements 28 extend from other portions of the ride vehicle (e.g., front portion 38, rear portion 40, top portion 42, a bottom portion) are also envisaged.

Figure 8:
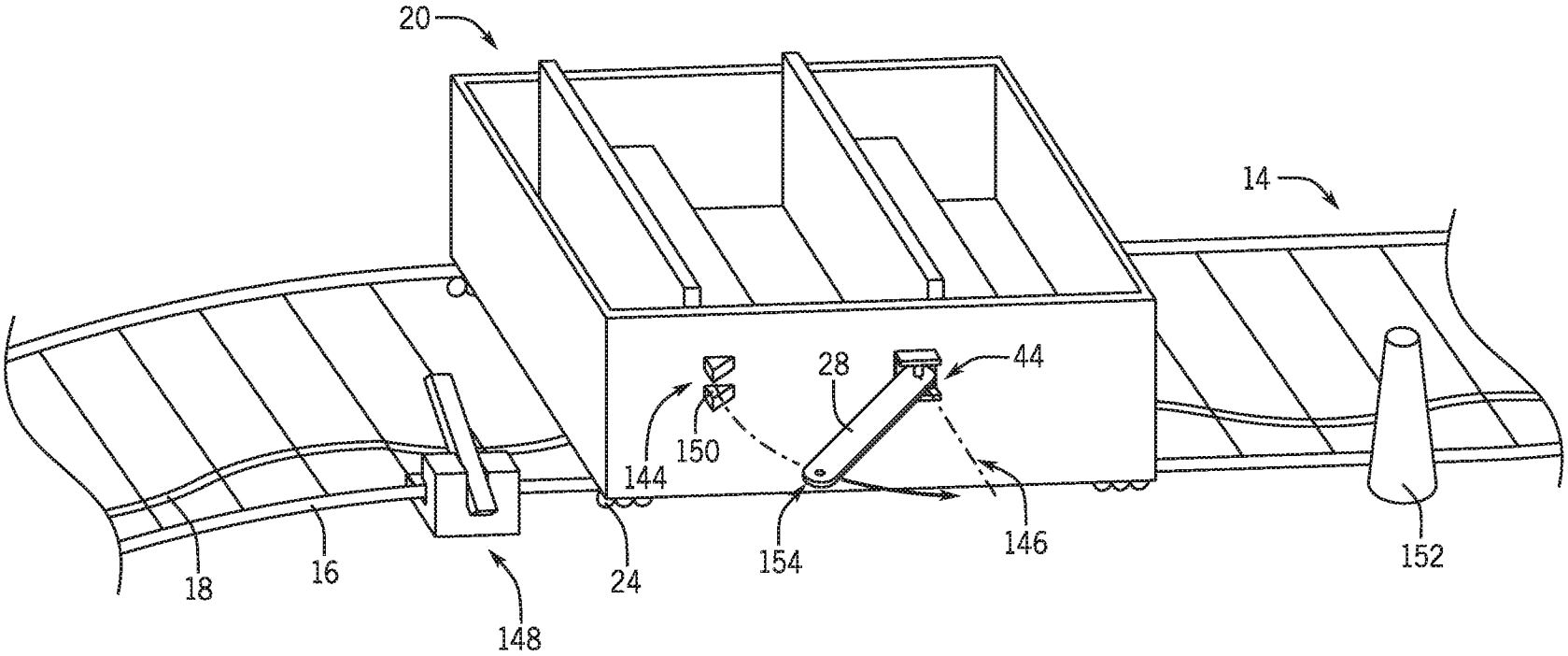
FIG. 8 is a perspective view of another embodiment of the ride vehicle having a show element moving from a stowed position to an open position.

FIG. 8 is a perspective view of an embodiment of the ride vehicle 20 having a show element 28 configured to move between a stowed position 144 and an open position 146. In the illustrated embodiment, a mechanical system 148 may be configured to cause the show element 28 to actuate from the stowed position 144 to the open position 146. The mechanical system 148 may be disposed proximate to the ride track 14. The mechanical system 148 may be configured to activate based on contact of the ride vehicle 20 with the mechanical system 148. The mechanical system 148 may be configured to activate based on contact of the show element 28 with the mechanical system 148. In some embodiments, the mechanical system 148 may be configured to activate based on contact of the friction wheel assembly 24 with the mechanical system 148. In some embodiments, the mechanical system 148 may be configured to uncouple the show element 148 from a coupling 150. The actuator 44 may be configured to move the show element 28 from the stored position 144 to the open position 146 when the show element 28 is uncoupled from the coupling 150. For example, the actuator 44 may be a spring configured to rotate the show element 28 from the stowed position 144 on the side of the ride vehicle 20 to the open position 146 when the show element 28 is uncoupled from the coupling 150. The show element 28 may extend out from the ride vehicle 20 in the open position 146. In some embodiments, the show element 28 may be disengaged from the mechanical linkage and/or accessory rail 18 in the stowed position 144. Moving the show element 28 to the open position 146 may engage the show element 28 with the mechanical linkage and/or accessory rail 18 such that the show 28 element moves based on the position of the accessory rail 18 with respect to the vehicle rail 16 when the show element 28 is in the open position 146.

In some embodiments, a mechanical storing system 152 may be configured to cause the show element 28 to move from the open position 146 to the stowed position 144. The mechanical storing system 152 may be disposed proximate to the ride track 14. The mechanical storing system 152 may be positioned such that the ride vehicle 20 passes by the mechanical system 148 before passing by the mechanical storing system 152 as the ride vehicle 20 travels along the ride track 14. In some embodiments, the mechanical storing system 152 may be configured to block a path of the show element 28 such that the show element 28 contacts the mechanical storing system 152 as the ride vehicle 20 moves along the track 14. The mechanical storing system 152 may be configured to push a coupling portion 154 of the show element 28 into the coupling 150, causing the show element 28 to couple to the coupling 150. The show element 28 is in the stowed position 144 when the show element 28 is coupled to the coupling 150.

Figure 9:
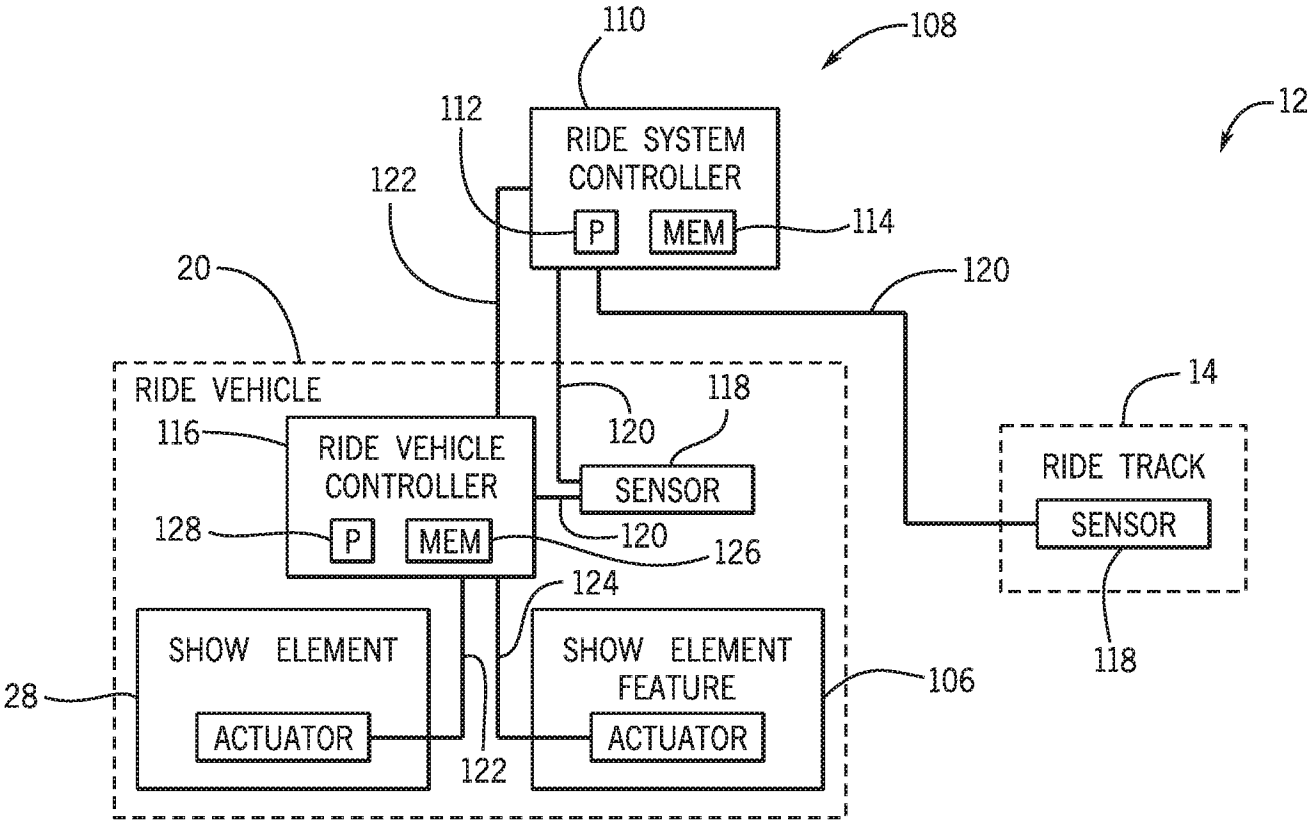
FIG. 9 is a block diagram of an embodiment of a ride vehicle control system for the amusement park attraction.

FIG. 9 is a block diagram of a ride vehicle control system 108 for the amusement park attraction 12. In some embodiments, the ride vehicle control system 108 has a ride system controller 110 that has a processor 112 and a memory 114. Moreover, the ride vehicle control system 108 may include a ride vehicle controller 116 and a sensor 118. In some embodiments, the sensor 118 is configured to detect a position of the show element 28 with respect to the ride vehicle 20 and output a ride condition signal 120 based at least in part on the position of the show element with respect to the ride vehicle 20. In another embodiment, the sensor 118 is configured to detect a position of the ride vehicle 20 along the ride track 14 and output the ride condition signal 120 based at least in part on the position of the ride vehicle 20 along the ride track 14. The ride system controller 110 is configured to receive the ride condition signal 120 from the sensor 118 and output a control signal (e.g., a show element position signal) 122 based at least in part on the ride condition signal 120.

In other embodiments, the ride vehicle controller 116 may be configured to receive the show element position signal 122 and relay the show element position signal 122 to the actuator 44. Relaying the show element position signal 122 to the actuator 44 may include receiving the show element position signal, processing the received show element position signal, and generating a new show element position signal. In some embodiments, the ride system controller 110 is configured to output the show element position signal 122 directly to the actuator 44. In another embodiment, the ride vehicle controller 116 is configured to receive a ride condition signal 120 directly from the sensor 118 and output the show element position signal 122 based at least in part on the ride condition signal 120. The actuator 44 is configured to receive the show element position signal 122 and adjust its position to actuate the show element 28 accordingly.

In another embodiment, the ride system controller 110 and/or the ride vehicle controller 116 is configured to output a show feature position signal 124 based at least in part on the ride condition signal 120. The show feature position signal 124 is configured to cause the actuator 44 to move the show element feature 106.

To facilitate these communications, the ride vehicle controller 116, the sensor 118, and the actuator 44 may include communications circuitry, such as antennas, radio transceiver circuits, signal processing hardware and/or software (e.g., hardware or software filters, A/D converters, multiplexer amplifiers), or a combination thereof. The communications circuitry may be configured to communicate over wired or wireless communication paths via IR wireless communication, satellite communication, broadcast radio, microwave radio, Bluetooth, Zigbee, Wifi, UHF, NFC, etc. Such communication may also include intermediate communications devices, such as radio towers, cellular towers, etc. If the actuator 44 is an electronic actuator, the actuator may include a battery. If the actuator 44 is pneumatic or hydraulic actuator, the actuator may include an accumulator. The battery and/or accumulator may be disposed on the ride vehicle 20 and may be periodically charged or filled up during operation of the ride vehicle system 10. For example, when amusement park attraction 12 may be configured to charge and/or fill up batteries and/or accumulators on the ride vehicle 20 when the ride vehicle 20 is stopped to load and/or unload passengers.

In certain embodiments, the ride vehicle controller 116 may include a memory device 126 storing instructions executable by a processor 128 to perform the methods and to control actions described herein. For example, the processor 128 may execute instructions stored on the memory device 126 for a response based on the ride condition signal 120 or other inputs received by the ride vehicle controller 116.

In the instant embodiment, the ride vehicle 20 does not include an on-board propulsion system. For example, the amusement park attraction 12 uses a propulsion system external to the ride vehicle 20 to propel the ride vehicle 20 up an incline. The ride vehicle 20 then uses potential energy and kinetic energy to proceed along the vehicle rail 12 through one or more kinetic zones. In such an embodiment, the amusement park attraction 12 may include multiple cycles of the ride vehicle 20 being propelled up an incline and then proceeding through one or more kinetic zones without propulsion. However, in other embodiments, the ride vehicle 20 may have an on-board propulsion system that is under the control of the ride vehicle controller 116.

The show element 28 is configured to move based at least in part on the show element position signal 122. The show element position signal 122 may include instructions from the ride system controller 110, the ride vehicle controller 116, or some combination thereof, to move the show element 28 upward, downward, forward, rearward, outward, inward, or some combination thereof, with respect to the ride vehicle base 22. The actuator 44 may be configured to actuate in response to the show element position signal 122 to move the show element 28. In some embodiments the actuator 44 is disposed on the ride vehicle 20. In another embodiment, the actuator 44 may be disposed on a portion of the amusement park attraction 12 off board the ride vehicle 20. Similarly, the sensor 118 may be disposed onboard the ride vehicle 20 or on a portion of the amusement park attraction 12 off board the ride vehicle 20.

In some embodiments, control of the ride vehicle 20, the show element 28, or both, may be altered based on environmental or weather conditions (e.g., high winds). For example, the show element 28 may be actuated to reduce aerodynamic drag on the ride vehicle 20 when measured wind gusts are above some threshold value.

Figure 10:
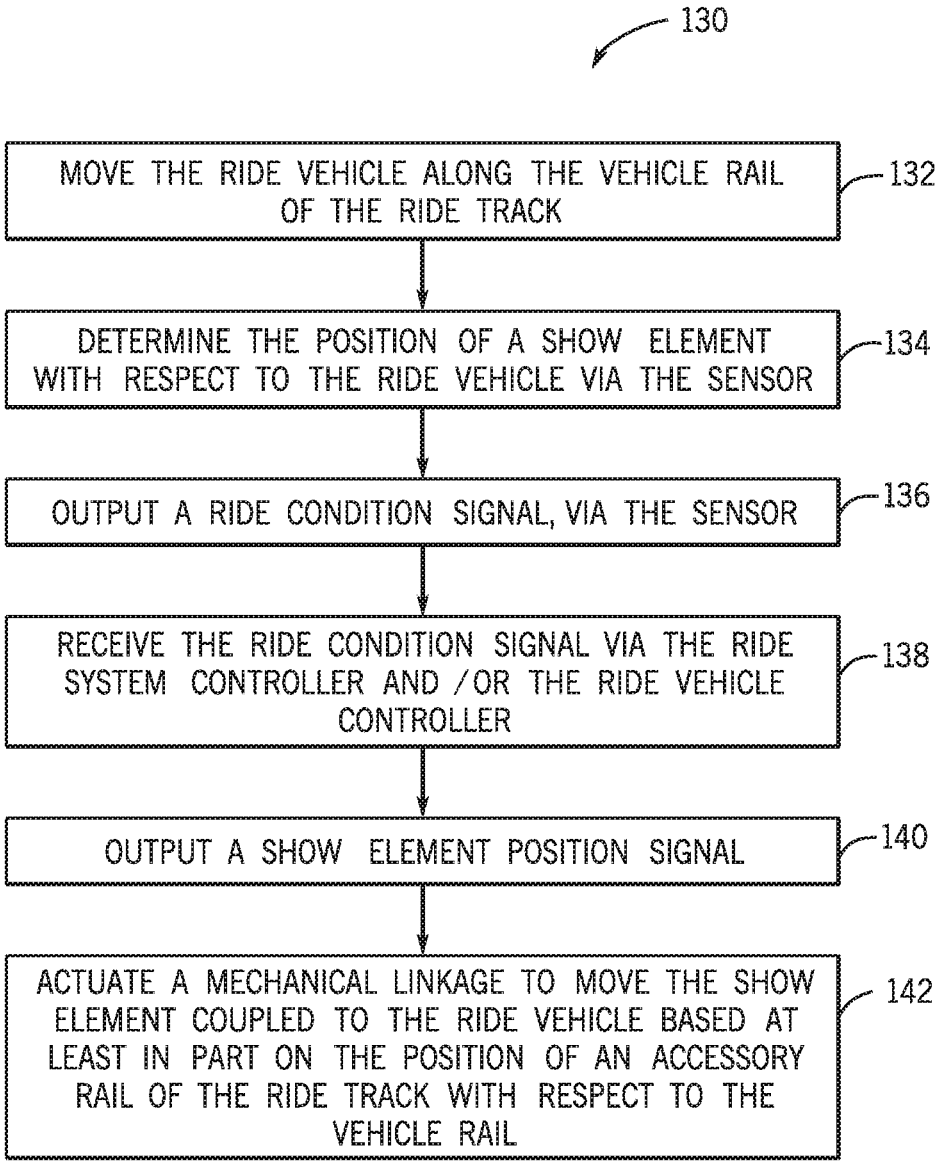
FIG. 10 is a flow diagram of an embodiment of a method to actuate the show element with respect to the ride vehicle in accordance with present techniques.

FIG. 10 is a flow diagram 130 of a method to actuate a mechanical linkage to move the show element with respect to the ride vehicle. At the start of the method, the ride vehicle may be movably coupled to the ride track. The method 130 includes the step of moving the ride vehicle along the vehicle rail of the ride track (block 132). The ride vehicle may be a roller coaster; therefore, moving the ride vehicle may include propelling the ride vehicle vertically up in a potential zone and gravity driving the ride vehicle through one or more kinetic zones.

The method 130 may include the step of determining a position of the ride vehicle along the ride track via the sensor. In some embodiments, the ride vehicle system includes a plurality of sensors configured to detect the ride vehicle along the ride track such that the ride vehicle control system receives updates as to the position of the ride vehicle at locations where the show element is configured to actuate. Moreover, the method 130 may include the step of determining the position of the show element with respect to the ride vehicle via the sensor (block 134). In some embodiments, the sensor may detect a current position of the show element such that the ride vehicle control system may verify that the show element is positioned correctly. In the event that the show element is not positioned correctly, the ride vehicle controller may output a show element position signal to move the show element to a correct position.

The method 130 may include the step of outputting a ride condition signal, via the sensor, (block 136) based at least in part on the detected position of the ride vehicle along the track and/or the detected position of the show element with respect to the ride vehicle. The ride vehicle controller may receive the ride condition signal (block 138) and determine instructions for the actuator. The method 130 may include the step of outputting a show element position signal (block 140), via the ride vehicle controller, based at least in part on the ride condition signal. Further, the method 130 may include actuating the show element and/or show element feature via the actuator based at least in part on the show element position signal.

In some embodiments, the method 130 may include the step of actuating the mechanical linkage to move the show element coupled to the ride vehicle based at least in part on the position of an accessory rail of the ride track with respect to the vehicle rail (block 142). In other embodiments, the mechanical linkage moves the show element based on changes in the distance between the accessory rail and a portion of the ride vehicle base. In some embodiments, the mechanical linkage moves the show element based on changes in the distance between the accessory rail and the ground. The position of the accessory rail is configured to vary with respect to the vehicle rail, the ground, or the ride vehicle base along the ride track. The position of the accessory rail may be offset from the vehicle rail in the horizontal and/or vertical directions. Moreover, the show element is configured to actuate with respect to the ride vehicle, the ground, or the ride vehicle base. Specifically, the mechanical linkage is configured to move to actuate the show element 28 upward, downward, forward, rearward, inward, outward, or some combination thereof with respect to the ride vehicle based at least in part on the position of the accessory rail with respect to the vehicle rail, the ground, or the ride vehicle base.

Technical effects of the disclosure include actuating a show element coupled to a ride vehicle. The systems and method disclosed herein may be used to create a unique visual experience for passengers to enjoy while traveling along the ride track of the amusement park attraction. The disclosed techniques may be used to move the show element using mechanical linkages, actuators, or some combination thereof to create the unique visual experience for the passengers.

While only certain features of the present disclosure have been illustrated and described herein, many modifications and changes will occur to those skilled in the art. It is, therefore, to be understood that the appended claims are intended to cover all such modifications and changes as fall within the true spirit of the present disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A ride vehicle system, comprising:

a ride track comprising a vehicle rail and an accessory rail; and a ride vehicle, comprising:

a ride vehicle base configured to interface with the vehicle rail of the ride track, wherein the ride vehicle base is configured to move along the vehicle rail of the ride track;

a show element coupled to the ride vehicle base, wherein the show element is configured to actuate with respect to the ride vehicle base; and a mechanical linkage comprising:

a first end coupled to the show element;

a second end configured to interface with the accessory rail of the ride track; and an intermediate portion configured to interface with the vehicle rail;

wherein the mechanical linkage is configured to move along the accessory rail and to rotate about a hinge disposed at the intermediate portion to actuate the show element based at least in part on a position of the accessory rail with respect to the vehicle rail.

2. The ride vehicle system of claim 1, wherein the mechanical linkage comprises multiple bodies coupled to one another via rigid or moveable joints, wherein the multiple bodies are configured to move based at least in part on the position of the accessory rail with respect to the vehicle rail.

3. The ride vehicle system of claim 1, wherein the ride track comprises a plurality of vehicle rails that interface with the ride vehicle.

4. The ride vehicle system of claim 1, wherein a distance between the accessory rail and the vehicle rail is configured to vary along the ride track, and wherein a change in the distance between the accessory rail and the vehicle rail actuates the show element by extending or retracting the show element.

5. The ride vehicle system of claim 4, wherein the show element is configured to extend or retract with respect to the ride vehicle base.

6. The ride vehicle system of claim 1, wherein a vertical position of the accessory rail is configured to vary with respect to the vehicle rail, and wherein a change in the vertical position between the accessory rail and the vehicle rail actuates the show element upward or downward.

7. The ride vehicle system of claim 1, wherein a horizontal position of the first end of the mechanical linkage is configured to vary with respect to the intermediate portion, and wherein a change in the horizontal position actuates the show element forward or rearward.

8. The ride vehicle system of claim 1, comprising an actuator configured to actuate the show element with respect to the ride vehicle, wherein the actuator is pneumatically, hydraulically, or electrically powered.

9. The ride vehicle system of claim 1, comprising a ride seat attached to the ride vehicle base of the ride vehicle.

10. A ride vehicle, comprising:

a ride vehicle base configured to interface with a vehicle rail of a ride track, wherein the ride vehicle base is configured to move along the vehicle rail of the ride track;

a show element coupled to the ride vehicle base, wherein the show element is configured to actuate with respect to the ride vehicle base, wherein the show element comprises a distal end and a proximal end, wherein the proximal end is coupled to the ride vehicle base, and wherein the distal end is configured to move upward, downward, forward, rearward, outward, inward, or some combination thereof, with respect to the proximal end; and a mechanical linkage comprising a first end coupled to the show element and a second end configured to interface with an accessory rail of the ride track, wherein the mechanical linkage is configured to actuate the show element based at least in part on a position of the accessory rail with respect to the vehicle rail.

11. The ride vehicle of claim 10, wherein the mechanical linkage is configured to actuate the show element upward, downward, forward, rearward, outward, inward, or some combination thereof with respect to the ride vehicle base.

12. The ride vehicle of claim 10, wherein the mechanical linkage is coupled to a side portion of the ride vehicle base.

13. The ride vehicle of claim 10, wherein the mechanical linkage is coupled to a front portion, a back portion, or a top portion of the ride vehicle base.

14. The ride vehicle of claim 10, comprising an actuator configured to drive actuation of the show element.

15. The ride vehicle of claim 14, wherein the actuator comprises a hydraulic actuator, pneumatic actuator, electric actuator, mechanical actuator, or some combination thereof.

16. The ride vehicle of claim 10, wherein the show element is configured to actuate based at least in part on a position of the ride vehicle along the ride track.

17. A method, comprising:

moving a ride vehicle along a vehicle rail of a ride track; and actuating a mechanical linkage to move a show element coupled to the ride vehicle based at least in part on a position of an accessory rail of the ride track with respect to the vehicle rail, wherein the mechanical linkage comprises multiple bodies coupled to one another via rigid or moveable joints, wherein the multiple bodies are configured to move based at least in part on the position of the accessory rail with respect to the vehicle rail, wherein the position of the accessory rail is configured to vary with respect to the vehicle rail along the ride track, and wherein the show element is configured to actuate with respect to the ride vehicle.

18. The method of claim 17, wherein the mechanical linkage is configured to actuate to move the show element upward, downward, forward, rearward, inward, outward, or some combination thereof, with respect to the ride vehicle.

* * * * *